US006985065B2

(12) United States Patent
Aguila

(10) Patent No.: US 6,985,065 B2
(45) Date of Patent: Jan. 10, 2006

(54) MOUNTING DEVICE FOR LAMINATED FUSES

(75) Inventor: Ramon Aguila, Valls (ES)

(73) Assignee: Lear Corporation, Southfield, MI (US)

( * ) Notice: Subject to any disclaimer, the term of this patent is extended or adjusted under 35 U.S.C. 154(b) by 221 days.

(21) Appl. No.: 10/707,552

(22) Filed: Dec. 20, 2003

(65) Prior Publication Data

US 2005/0134423 A1 Jun. 23, 2005

(51) Int. Cl.
*H01H 85/15* (2006.01)
*H01H 85/165* (2006.01)
*H01R 13/68* (2006.01)

(52) U.S. Cl. ..... 337/235; 337/187; 337/191; 337/252; 361/837; 439/366; 439/890

(58) Field of Classification Search ..... 337/159, 337/180, 181, 186, 187, 191, 231, 235, 251, 337/252; 361/642, 646, 833, 837; 439/250, 439/621, 698, 830, 366, 890
See application file for complete search history.

(56) References Cited

U.S. PATENT DOCUMENTS

| | | | | | |
|---|---|---|---|---|---|
| 588,611 | A * | 8/1897 | Stern | 396/345 |
| 633,846 | A * | 9/1899 | Ingersoll | 128/203.15 |
| 1,950,489 | A * | 3/1934 | Glowacki | 337/254 |
| 2,056,118 | A * | 9/1936 | Basse | 337/18 |
| 2,195,147 | A * | 3/1940 | Griffith | 337/233 |
| 2,325,698 | A * | 8/1943 | Millermaster et al. | 439/737 |
| 2,497,227 | A * | 2/1950 | Messer et al. | 337/233 |
| 2,521,600 | A * | 9/1950 | Pflaum | 337/233 |
| 2,548,290 | A * | 4/1951 | Detch | 337/233 |
| 2,560,138 | A * | 7/1951 | Swain | 337/233 |
| 2,644,871 | A * | 7/1953 | Detch | 337/233 |
| 2,662,141 | A * | 12/1953 | Detch | 337/233 |
| 2,681,399 | A * | 6/1954 | Detch | 337/233 |
| 2,793,269 | A * | 5/1957 | Detch | 337/233 |
| 4,050,045 | A * | 9/1977 | Motten et al. | 337/187 |
| 4,692,835 | A * | 9/1987 | Setoguti et al. | 361/104 |
| 4,723,117 | A * | 2/1988 | Griffiths | 337/186 |
| 5,088,940 | A * | 2/1992 | Saito | 439/621 |
| 5,580,281 | A * | 12/1996 | Takeuchi | 439/621 |
| 5,620,337 | A * | 4/1997 | Pruehs | 439/508 |
| 5,643,693 | A * | 7/1997 | Hill et al. | 429/121 |
| 5,685,679 | A * | 11/1997 | Sugiura | 411/104 |
| 5,700,165 | A * | 12/1997 | Harris et al. | 439/621 |
| 6,456,188 | B1 * | 9/2002 | Tsuchiya | 337/235 |
| 6,459,354 | B2 * | 10/2002 | Konda et al. | 337/9 |
| 2005/0122203 | A1 * | 6/2005 | Jur et al. | 337/159 |

FOREIGN PATENT DOCUMENTS

EP 1103998 A2 * 5/2001

* cited by examiner

*Primary Examiner*—Anatoly Vortman
(74) *Attorney, Agent, or Firm*—Bruce E. Harang

(57) ABSTRACT

The present invention provides for a device allowing the mounting of laminated fuses onto a fuse support using a preferably square washer that is positionally held by a plurality of stops incorporated into said fuse support. The plurality of stops and square washer preventing the rotational movement of the nut being tightened during mounting of the laminated fuse from distorting or breaking said laminated fuse.

5 Claims, 1 Drawing Sheet

MOUNTING DEVICE FOR LAMINATED FUSES

BACKGROUND OF INVENTION

1. Field of the Invention

The present invention is directed to an improvement for mounting a laminated fuse to its respective support, suitable for use with the known screw-down fuse mounting method.

The object of the invention is to eliminate the risk of breakage and distortion for the laminated fuse during the tightening of the respective screw-down nuts.

The invention is particularly suitable for use in the automobile industry, specifically in the fuse-holding supports that make up the general safety group of the electrical circuitry of a vehicle.

2. Description of the Related Art

In the preferred field of application for the invention, that of vehicles, fuses are widely used in which the fuses have opposing flat ends equipped with bores through which screws or threaded rods integrated into the complementary support are passed, fixedly connecting the fuse by means of a pair of threaded nuts to the aforementioned screws or threaded rods.

During the nut tightening operation, necessary to ensure both the mechanical stability and electrical continuity of the fuse, these nuts rub against the fuse flat ends which they come in contact with. This contact by the nuts with the fuse flat ends during the tightening operation causing the flat ends of the fuse on many occasions to be distorted or broken.

In attempting to avoid this problem the use of round washers is known. The round washer takes the rotational friction stress caused by the turning movement of the nut during the tightening operation. This solution works when the mounting and seating of the nuts is carried out manually. However, it does not solve the previously mentioned problem for the nut tightening operation in automated processes, as the knock of the machine nut tightening operation instantly transmits the rotational strain to the fuse, causing frequent breaking or distortion of the fuse.

DISCLOSURE OF THE INVENTION

The present invention solves the previously explained problem, ensuring proper mounting of laminated fuses substantially without breakage or distortion.

More specifically, said device is based on the use of a flat washer that is square in shape and is held in substantially stationary position by the design of the fuse support.

More particularly in the support housing, for each fuse, washer positioning stops are provided to fix the flat square washer in an angular direction, within in its own plane, so that the rotational strain generated by the machine tightening operation are transmitted from the washer to the support, through the aforementioned stops, without being transmitted to the ends of the fuse, which is thereby protected from distortion and/or breakage.

The aforementioned washer could be rectangular instead of square, but the square configuration is presently preferred in order to avoid the need for selecting a specific positioning of the washer on the support.

In fact any washer shape having suitable dimensions may be used with the establishment of appropriate stop supports, to prevent the rotating movement of the washer, and obviously without the layout of said stops interfering with the assembly of the fuse on said support.

DETAILED DESCRIPTION

Figure 1:
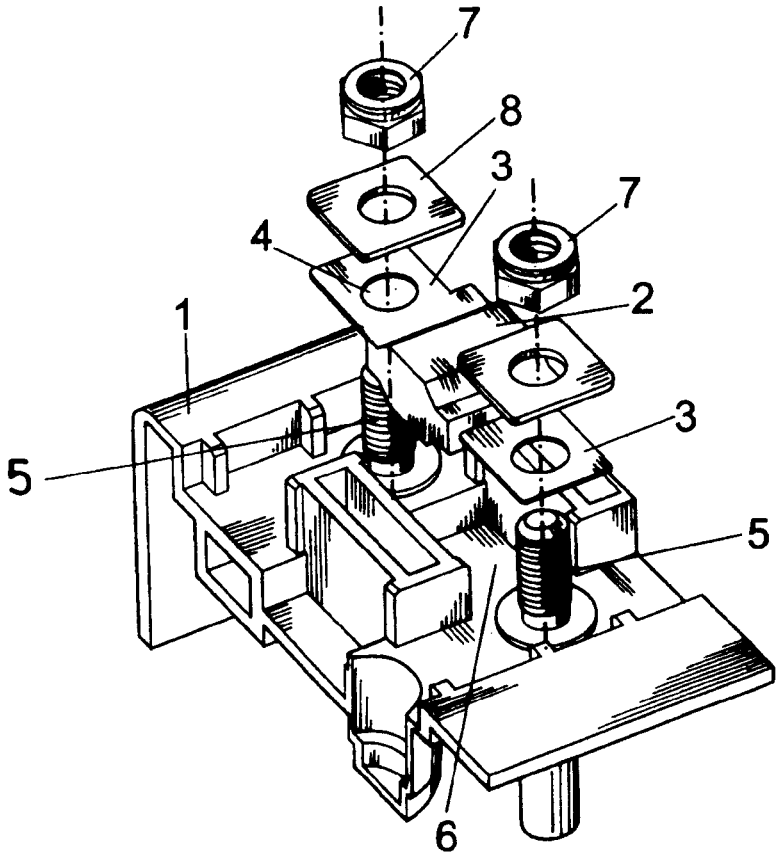
FIG. 1 shows an exploded view in perspective of a section of the laminated fuse and its respective support, equipped with a fixing device of the present invention.
Figure 2:
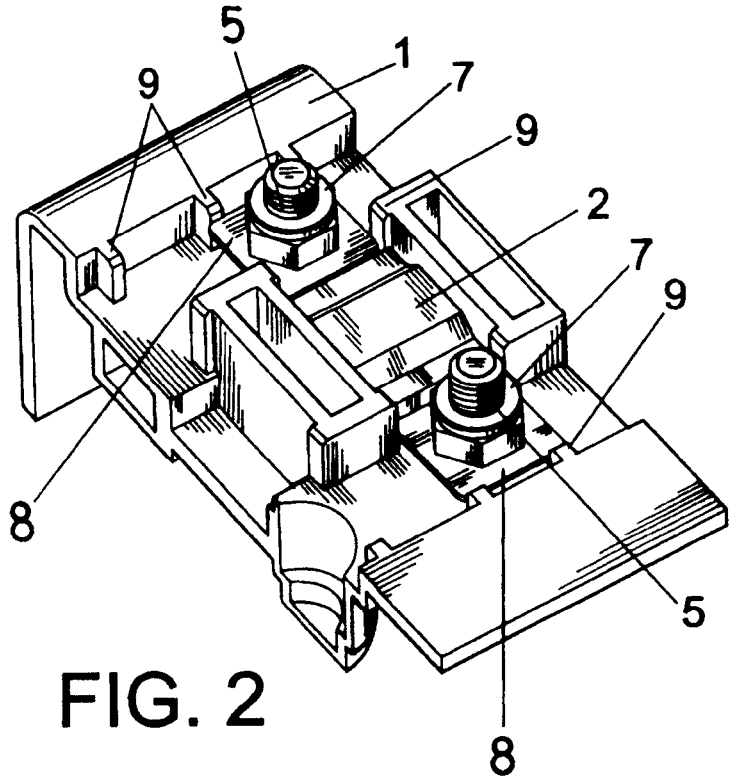
FIG. 2 shows, a section in perspective, having the same group of components as in FIG. 1, fully assembled.

Reference will now be made to the drawings, wherein to the extent possible alike reference numerals are utilized to designate alike components throughout the various views.

In the figures there is shown a section of support (1) suitable to receive a plurality of laminated fuses (2), the specific configuration of laminated fuses (2) is shown merely for illustration purposes, as suitable fuse configurations can include any of the known different types of laminated fuses (2) available on the market. Fuses (2) having as a common denominator a pair of opposing flat ends (3) said flat ends (3) each having a bore (4) for the mounting of said fuse (2) on screws or threaded rods (5) emerging from each of a plurality of housings (6) formed in the support (1) for the mounting of fuse (2), said fuse fixedly mounted to the support (1) by the nuts (7).

In accordance with the invention, between each flat end (3) of fuse (2) and the respective nut (7) a is provided, said nut having a square shape, designed to fit into support (1) between a number of stops (9) positioned in support (1), said stops (9) acting on the edges of flat square washer (8) thereby substantially preventing rotation within its horizontal plane during the tightening of the nuts (7).

In this manner substantially all the rotational strain generated by the nuts (7) during the tightening process is absorbed by the flat square washers (8) and transmitted through these to the support (1), without the transmission of rotational strain to the ends (3) of the fuse (2) thereby substantially eliminating the risk of breakage or deformation to said fuse (2).

What is claimed is:

1. A device for mounting laminated fuses comprising:

a housing having at least one support having two end areas, said support having a threaded mounting means on each end area and a plurality of stops on each end of said support; a laminated fuse having flat ends and said flat ends each having a bore for mounting said laminated fuse on said threaded mounting means of said support;

a flat washer having a plurality of lateral sides for mounting on said threaded mounting means after said laminated fuse is mounted thereto; and a nut tightened onto each of said threaded mounting means on top of said laminated fuse end and said flat washer; thereby fixedly mounting said laminated fuse to said housing substantially without distorting or breaking said laminated fuse due to rotational motion of said nut being tightened onto said threaded mounting means.

2. A device for mounting laminated fuses as claimed in claim 1, wherein said flat washer has a square configuration.

3. A device for mounting laminated fuses as claimed in claim 1, wherein said flat washer has a rectangular configuration.

4. A device for mounting laminated fuses as claimed in claim 1, wherein said flat washer has more than four sides.

5. A device for mounting laminated fuses as claimed in claim 1, wherein said stops and said flat washers are dimensioned to allow for rapid automated mounting of said flat washers.

* * * * *